United States Patent [19]

Barnes

[11] 4,356,681

[45] Nov. 2, 1982

[54] METHOD AND APPARATUS FOR HEATING CONTAINERS HAVING A PRODUCT LIQUID THEREIN

[75] Inventor: William M. Barnes, Creve Coeur, Mo.

[73] Assignee: The Seven-Up Company, St. Louis, Mo.

[21] Appl. No.: 202,865

[22] Filed: Oct. 31, 1980

[51] Int. Cl.[3] ..... B65B 3/04

[52] U.S. Cl. ..... 53/440; 53/467; 99/323.1; 99/483; 426/397; 141/11; 141/82

[58] Field of Search ..... 99/367, 368, 483, 323.1, 99/323.3; 426/397, 477, 399, 401, 590; 141/1-12, 69-83, 85-93; 53/440, 467

[56] References Cited

U.S. PATENT DOCUMENTS 3,851,071 11/1974 Roehrig et al. ..... 426/477
3,983,259 9/1976 Maior ..... 99/368

OTHER PUBLICATIONS

I&H Conveying & Machine Company flyer re Warmers.
Standard Metal Products Company flyer re Can/Bottler Warmer.
Southern Tool Company, Inc. brochure re Bottle and Car Warmer.

*Primary Examiner*—Houston S. Bell, Jr.
*Attorney, Agent, or Firm*—Senniger, Powers, Leavitt and Roedel

[57] ABSTRACT

A method for heating containers having a product liquid therein utilizing the heat of condensation of a compressed refrigerant vapor. A first fluid medium is heated by transfer of heat from the compressed refrigerant vapor, thereby condensing the vapor to provide a liquid refrigerant useful for cooling. The containers are contacted with the heated fluid medium in the first stage of a container heating system having a plurality of stages, thereby transferring heat from the first medium to the containers. Thereafter the containers are contacted with a second fluid medium in a second stage of the system, the second medium entering the second stage at a temperature higher than the temperature at which the refrigerant vapor is condensed. The containers are heated in the system to a temperature above the dew point of the ambient air, thereby preventing condensation of moisture on the outside surfaces of the side walls of the containers leaving the system. Apparatus useful in carrying out the process is also disclosed.

24 Claims, 13 Drawing Figures

ILLUSTRATIVE COMPOSITE WARMING CURVE FOR TWO STAGE WARMING

METHOD AND APPARATUS FOR HEATING CONTAINERS HAVING A PRODUCT LIQUID THEREIN

BACKGROUND OF THE INVENTION

This invention relates to the field of packaging liquid products and more particularly to a novel method and apparatus for conserving energy in the packaging of liquids such as carbonated beverages.

In the bottling or canning of carbonated beverages, it is necessary for the bulk liquid to be cooled prior to filling of the bottles or cans. Unless the bulk liquid is cooled to a temperature substantially below ambient, for example 35°-40° F., excessive foaming is encountered in the filling operation, causing spillage. Because of the necessity of cooling the bulk carbonated liquid to such relatively low temperatures, refrigeration is required. Typically, ammonia vapor compression refrigeration systems are used, although other refrigerants are suitable including, for example, Freon 12, Freon 22, and Freon 115. The bulk liquid may be cooled either by direct exchange with evaporating refrigerant or by means of an intermediate brine system.

After cans or bottles have been filled with cold liquid, it is essential to warm the containers to a temperature above the dew point of ambient air prior to packing of the containers in cartons if conventional cardboard type cartons are used. Otherwise, moisture formed by condensation on the outside surfaces of the containers infiltrates and causes deterioration of the cardboard cartons. The temperature to which the containers must be heated prior to packing in cartons, of course, varies with ambient conditions but as a rule of thumb cans or bare glass containers are typically heated to an internal liquid temperature of about 80° F., while containers having an outer insulating plastic cover (such as Plastishield bottles) are heated to an internal liquid temperature of approximately 70° F.

Heating of the containers is typically carried out in a so-called "warming machine". The containers are carried through the machine on a conveyor belt and either immersed in or sprayed with an aqueous warming solution. The solution is primarily water, containing a small percentage of an algicide. After heat is transferred from the solution to the containers, the solution is reheated and then recirculated to the container warming zone. Residual warming solution on the outside sufaces of containers exiting the machine is removed by a blast of warm air over the bottle surfaces.

The unfortunately conflicting requirements of first refrigerating the bulk liquid prior to the filling operation and thereafter warming the filled containers above the dew point results in substantial energy consumption, which represents a rapidly increasing cost in the bottling of carbonated beverages. A serious need, therefore, exists for techniques and equipment which may reduce the energy consumed in these operations.

Where the bulk carbonated liquid is cooled by means of vapor compression refrigeration utilizing a refrigerant such as ammonia, compressor discharge pressure is typically in the range of 180 to 190 psia so that the ammonia condensation temperature is typically on the order of 95° F. Since this condensation temperature is normally above the ambient dew point and well above the temperature of the containers as filled, an energy savings can theoretically be accomplished by using the heat of condensation of the ammonia as a source of heat for warming the filled containers. It is understood that various attempts have been made in the art to implement such a scheme for energy recovery but, so far as is known, none has previously come to practical fruition. There is no practical technique for direct exchange of heat from condensing refrigerant to filled containers. It is theoretically feasible to recover this energy by heating the warming solution of a conventional container warming machine operation by employing it as a coolant in condensing the refrigerant. However, in view of the relatively narrow temperature differential between the condensing temperature of ammonia at 180-190 psia and the "ambient dew point," has heretofore rendered it has generally been considered impractical to use the heat of condensation of a refrigerant as an energy source for warming. In fact, warming machines typically operate with an inlet warming solution temperature in the range of 130°-140° F., which is not attainable through heating by ammonia condensation at the compressor discharge temperatures used in conventional ammonia refrigeration. Moreover, to maintain productivity, the flow of warming solution through the warming machine is normally maintained at a level such that the temperature drop of the solution is only 5°-10° F.

SUMMARY OF THE INVENTION

Among the several objects of the present invention, therefore, may be noted the provision of a practical method for reducing the energy consumption in the packaging of liquids, more particularly in the canning or bottling of carbonated beverages; the provision of a method for utilizing the heat of condensation of a refrigerant as a source of energy in warming containers filled with cold liquid to a temperature above the ambient dew point; the provision of such a method, which is adapted for implementation in a conventional bottling or canning line for carbonated beverages; the provision of such a method which can be implemented by modification of conventional existing warming equipment; the provision of such a method which can implemented without adverse impact on the capacity of existing or a conventional warming equipment; the provision of such a method which can be implemented by retrofitting existing facilities; the provision of such a method which can be implemented at modest capital cost and conversion cost; and the provision of novel apparatus adapted for carrying out such method.

Briefly, therefore, the present invention is directed to a method for heating containers having a product liquid therein utilizing the heat of condensation of a compressed refrigerant vapor. In the method, a first fluid medium is heated by transfer of heat from the compressed refrigerant vapor, thereby condensing the vapor to provide a liquid refrigerant useful for cooling. The containers are contacted with the first heated fluid medium in the first stage of a container heating system having a plurality of stages, thereby transferring heat from the first medium to the containers. Thereafter the containers are contacted in a second stage of the system with a second fluid medium which enters the second stage at a temperature higher that the temperature at which the refrigerant vapor is condensed. The containers are heated in the system to a temperature above the dew point of the ambient air, thereby preventing condensation of moisture on the outside surfaces of the side walls of the containers leaving the system.

The invention is also directed to an improvement in a process for bottling carbonated liquid wherein the liquid is cooled by refrigeration prior to the filling of containers therewith and the filled containers are thereafter warmed so that the surface temperature of the sides of each of the containers is above the dew point of the ambient air, thereby preventing condensation of moisture thereon prior to packing in cardboard cartons. According to the improvement, heat is transferred from a compressed refrigerant vapor to a first liquid heating medium, thereby condensing the vapor to provide a liquid refrigerant. The filled containers are contacted with the liquid heating medium in the first stage of a container heating system having a plurality of stages, thereby transferring heat from the first medium to the containers. The containers are thereafter contacted with a second liquid medium in a second stage of the system, the second medium entering the second stage at a temperature higher than the temperature at which the refrigerant vapor is condensed. The containers are heated in the system to a temperature higher than the dew point of the ambient air, thereby prevent condensation of moisture on the outside surfaces of the side walls of the containers leaving the system.

The invention is further directed to apparatus for heating containers having a product liquid therein and utilizing a low temperature heat source for supplying a portion of the heat. The apparatus includes a housing containing a plurality of heating zones and a horizontal belt conveyor for transporting the containers through the heating zone. There are means for contacting the containers on the conveyor with a relatively low temperature liquid heating medium in a low temperature heating zone within the housing and means for contacting the containers on the conveyor with a higher temperature liquid heating medium in a higher temperature heating zone within the housing downstream of the low temperature heating zone with respect to the transit of containers on the conveyor. A trough in the housing below the conveyor collects the heating media after contact of the containers therewith. An upright insulating partition in the trough defines and serves as a barrier between the low temperature sump upstream of the barrier and beneath the low temperature zone for collection of the low temperature medium and a higher temperature sump downstream of the barrier and beneath the higher temperature zone for collection of the higher temperature liquid medium.

Also comprehended by the invention is apparatus for heating containers having a product liquid therein utilizing the heat of condensation of a compressed refrigerant vapor. This apparatus comprises condenser means for transferring heat to a first fluid heating medium from the compressed refrigerant vapor and condensing the vapor to provide a refrigerant liquid useful for cooling. A heating system for the containers comprises a plurality of stages, the first stage of which comprises means for contacting the containers with the first medium and the second stage of which comprises means for contacting the containers with the second fluid heating medium. The apparatus further includes heat exchanger means for transferring heat to the second fluid heating medium; means for circulating the first medium between the condenser means and the first stage; and means for circulating the second medium between the heat exchanger means and the second stage.

Other objects and features will be in part apparent and in part pointed out hereinafter.

BRIEF DESCRIPTION OF THE DRAWINGS

Corresponding reference characters indicate corresponding parts in the several views of the drawings.

DESCRIPTION OF THE PREFERRED EMBODIMENTS

In accordance with the present invention, it has been discovered that a unique two-stage heating system allows the heating of condensation of a refrigerant to be used in heating cold newly filled carbonated beverage containers to a temperature above the ambient dew point. Heat released by condensation of the refrigerant is utilized in heating a first relatively low temperature fluid which is used to contact the containers in the first stage of a container heating system having a plurality of stages. Thereafter the containers are contacted with a second higher temperature heating medium in a second stage of the system, bringing the containers (or at least the outside surfaces of the side walls thereof) to a temperature above the ambient dew point. Condensation of moisture on the containers leaving the heating system is thereby prevented.

Conventional container warming equipment can be readily modified for implementation of the process of the invention and, in fact, an exisiting commercial beverage packaging line may be readily retrofitted at modest cost to operate in accordance with the method of the invention by appropriate modifications to warming machines, addition of process equipment and re-piping. Because the second stage of the warming system may be operated using a heating fluid which enters that stage at a temperature that is not only higher than the temperature at which the refrigerant vapor is condensed but may also be higher than the average temperature of the warming solution with which containers are conventionally contacted, the method of the invention can be implemented with no loss of capacity in an existing bottling or canning line.

Figure 1:
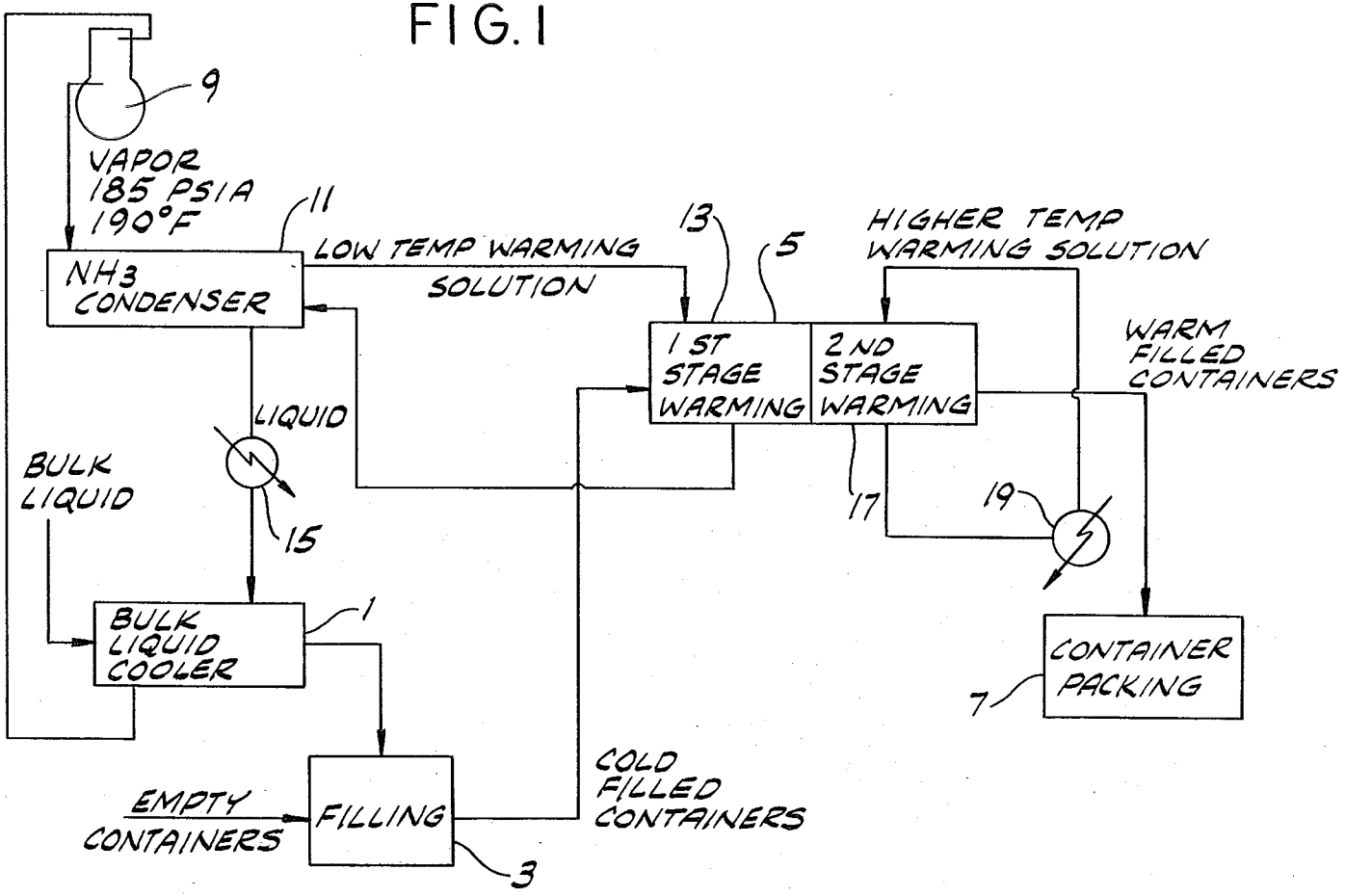
FIG. 1 is a general schematic diagram outlining the basic steps of the method of the invention.

Illustrated in FIG. 1 is a general schematic flow sheet for application of the method of the invention to a carbonated beverage packaging system. Bulk carbonated liquid is chilled by evaporation of refrigerant in bulk liquid cooling system 1, which may optionally include a brine circulation system for chilling the bulk carbonated liquid in one surface heat exchanger and transferring heat to an evaporating refrigerant in another surface exchanger. Whether by direct or indirect exchange, the refrigerant serves as the heat sink for chilling the carbonated liquid. Chilled liquid is pumped to filling line 3 where empty containers are filled at a temperature low enough to prevent excessive foaming and overflow. Cold filled containers are then fed to a two-stage heating system 5 where they are heated to a temperature above the ambient dew point prior to transfer to a carton packing operation 7.

Refrigerant evaporated in bulk liquid cooling system 1 is compressed in a compressor 9 and condensed in a surface condenser 11 by exchange of heat with a low temperature warming solution that is circulated between the refrigerant condenser and the first stage 13 of heating system 5. Liquid refrigerant may be subcooled in another exchanger 15 prior to being fed to the bulk liquid cooling system. Where ammonia is the refrigerant, the compressor discharge pressure is typically in the range of 180–190 psia and the super-heated vapor is at a temperature of approximately 190° F. Condensation in condenser 11 takes place at about 95° F. and, by use of countercurrent flow in the condenser, the warming fluid circulated between first stage 13 and condenser 11 can be raised to a temperature of approximately 93° F. leaving the condenser.

After the containers pass through first stage 13 of heating system 5 they enter a second stage 17 where they are contacted with a second higher temperature heating fluid. The fluid used for contacting the containers in stage 17 is heated by circulation through an external heat exchanger 19 where the second medium is typically heated with steam.

Figure 4:
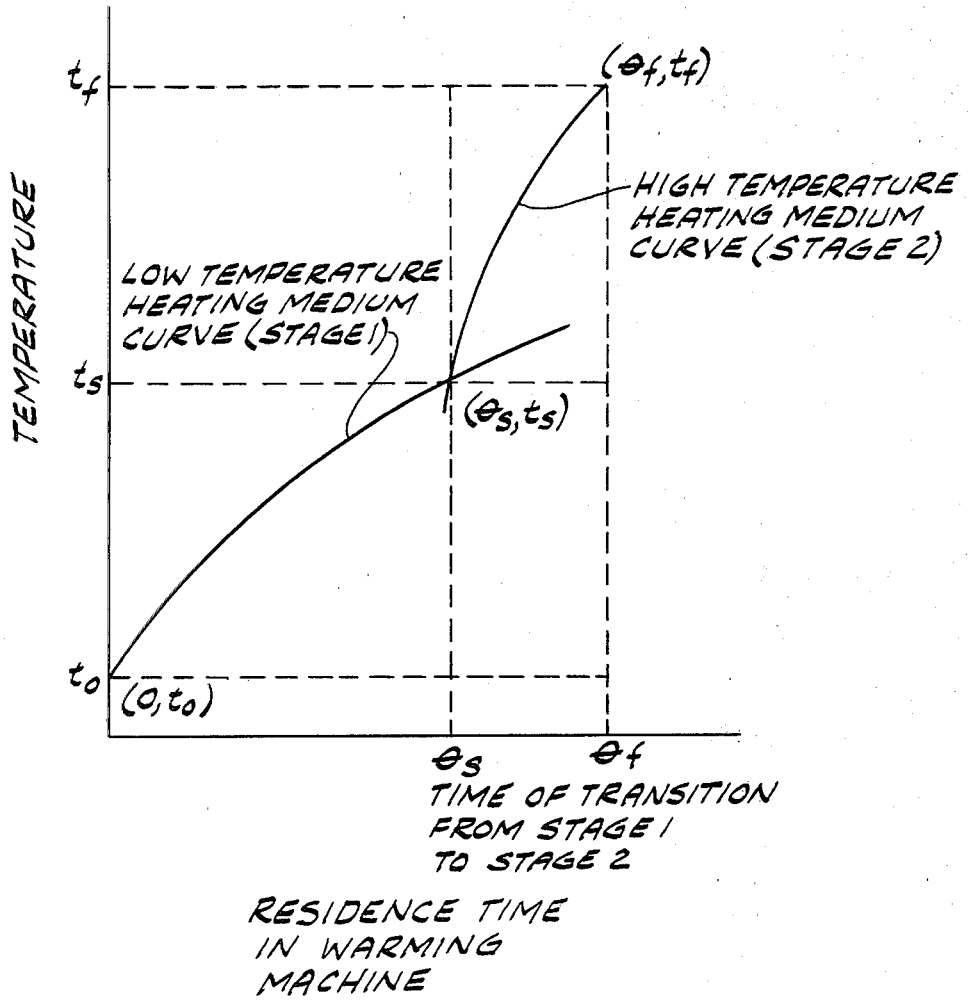
FIG. 4 is a composite warming curve illustrating the warming rates effected with the first and second fluid media, respectively, in the zones of a two-zone warming system.

FIG. 4 illustrates the principle of operation of the method of the invention. Where is the residence time in the warming machine corresponding to the bottling line production rate, t is the temperature to which the containers are heated and t is the temperature of the containers entering the warming machine, the relative time and length of travel in the respective stages of a two-stage heating operation may be determined from the intersection of the first stage low temperature heating medium warming curve plotted forwardly from the point $(0,t_o)$ with the second stage higher temperature curve back-plotted from the point $(\theta_f,t_f)$. For a constant speed conveyor, the point of transition from stage one to stage two is readily determined from the transition $(\theta_s,t_s)$ defined by the intersection of the curves.

Figure 2:
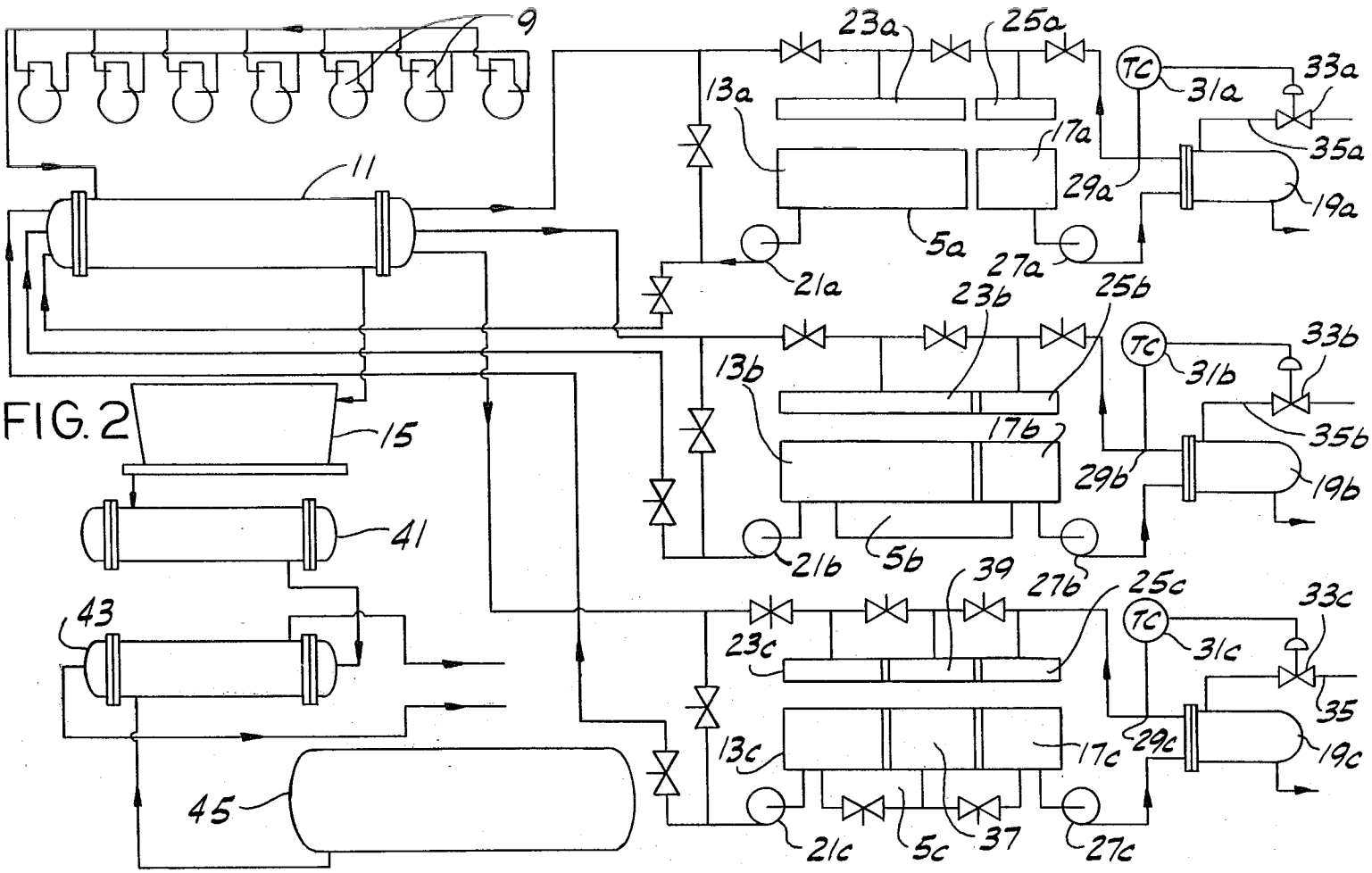
FIG. 2 is a schematic diagram outlining a flow sheet and apparatus useful in carrying out of the method of the invention.

Illustrated in FIG. 2 is a more detailed flow sheet illustrating a practical arrangement of process equipment in an apparatus adapted for implementing the method of the invention in a commercial plant for bottling and canning carbonated beverages. The flow sheet of FIG. 3 includes three warming machines **5*a*, 5*b*, and 5*c*. Warming solution is circulated between first stage 13*a* of machine 5*a* and refrigerant condenser 11 by means of circulating pump 21*a* and associated piping. Heated low temperature heating medium returning to the machine from shell and tube condenser 11 is sprayed over containers in first stage 13*a* by means of a spray header 23*a*. Identical facilities are provided for circulation of low temperature liquid heating medium between first stage 13*b* of warming machine 5*b* and condenser 11, the latter arrangement including circulation pump 21*b* and spray header 23*b*. Each of warming machines 5*a* and 5*b* also includes a second stage (17*a*, 17*b*) comprising a spray header (25*a*, 25*b*). A second liquid heating medium is circulated between each second stage (17*a*, 17*b*) and an external surface heat exchanger (19*a*, 19*b*) comprising means for transferring heat to the second fluid heating medium. The second external exchanger is typically a shell and tube surface exchanger in which the second liquid heating medium is heated by condensation of steam. In each case, circulation of the second normally higher temperature liquid heating medium is effected by means of a circulating pump (27*a*, 27*b*) and associated piping. Temperature of the second stage liquid medium is measured by a temperature sensor (29*a*, 29*b*) which transmits a signal to a temperature controller (31*a*, 31*b*) that controls temperature by operation of a control valve (33*a*, 33*b*) in the steam supply (35*a*, 35*b***) to the exchanger.

Warming machine **5*c* is provided with the same auxiliary equipment as machines 5*a* and 5*b*. However, the piping and valving is arranged so that a center section 37 of machine 5*c* and an associated spray header 39 may be incorporated in either first stage 13*c* or second stage 17*c***.

Refrigerant liquid exiting condenser 11 is transported by gravity through an evaporative cooler 15, where it is subcooled, and thence passes to a liquid refrigerant receiver 41 and to a means for vaporizing carbon dioxide and further subcooling the refrigerant comprising a carbon dioxide vaporizer 43. Vaporizer 43 comprises a shell and tube surface heat exchanger which receives liquid carbon dioxide on the shell side and liquid refrigerant on the tube side. Carbon dioxide from a CO bulk storage tank 45 is vaporized in the shell of exhanger 43 by absorption of heat from the liquid refrigerant, thereby further subcooling the refrigerant. Vaporized carbon dioxide is used in carbonation of the liquid beverage which is to be packaged while the liquid refrigerant is used in cooling the bulk carbonated liquid as illustrated in FIG. 1.

As indicated ammonia is conventionally used as the refrigerant in the chilling of bulk carbonated beverages prior to filling of containers therewith. However, the method of the invention can be implemented with other refrigerant materials, particularly those which are condensed under moderate pressure at temperatures above the ambient dew point and evaporate near atmospheric pressure at temperatures low enough to provide a heat sink for chilling the bulk carbonated beverage to temperatures in the range of 35°–40° F. Thus, for example, it may be feasible to use alternative refrigerants such as chlorodifluoromethane (refrigerant 22), chloropentafluoroethane (refrigerant 115), the azeotropic mixture containing 73.8% dichloromethane and 26.2% dichloroethane (refrigerant 500) and the azeotropic mixture containing 48.8% chlorodifluoromethane and 51.2% chloropentachloroethane (refrigerant 502).

Figure 3:
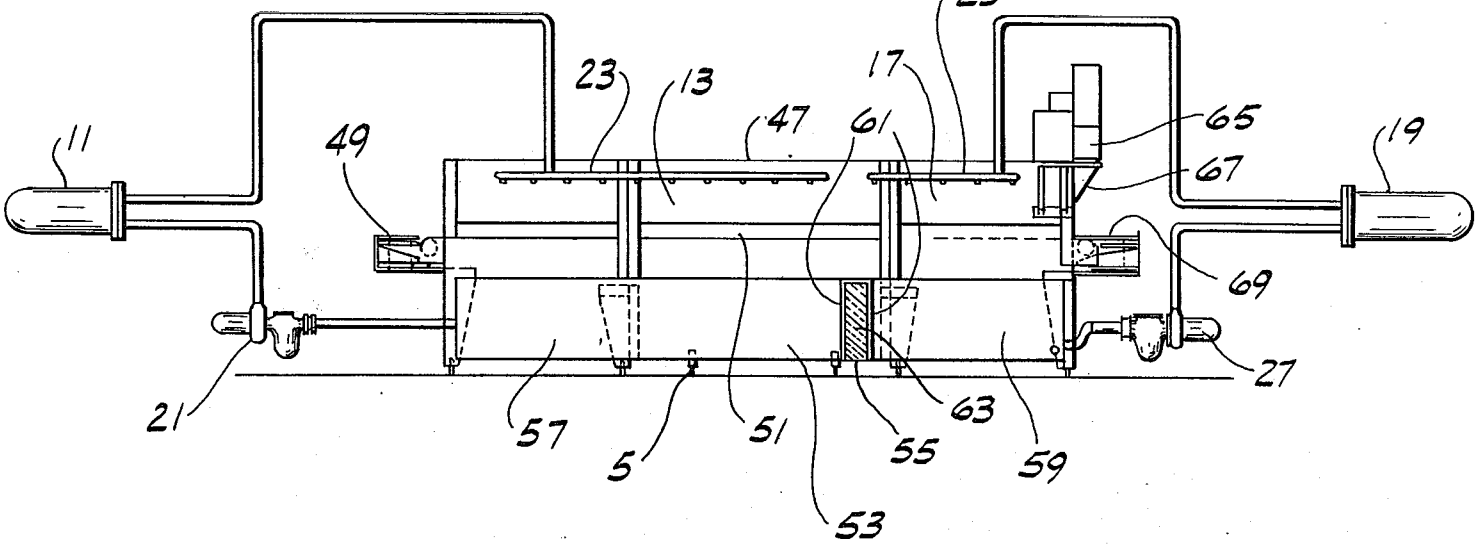
FIG. 3 is an elevation drawing showing the warming apparatus of the invention.

Illustrated in FIG. 3 is a novel modified warming machine useful in carrying out the method of the invention, shown together with auxiliary solution heating and circulation equipment. The warming machine 5 comprises a housing 47 which contains heating zone 13 where the containers are contacted with a relatively low temperature liquid heating medium and zone 17 where the containers are contacted with a higher temperature liquid heat medium. Containers to be warmed enter the machine on an infeed conveyor 49 and are transported through the heating zone on a horizontal flat top belt conveyor 51 that is preferably of mesh or chain construction or otherwise provided with openings therein through which the heating media may flow after passage over the containers to be heated. In zone 13 the containers are contacted with the relatively low temperature liquid medium by means of spray header 23 disposed above conveyor 51 and in zone 17 the containers are contacted with the higher temperature liquid medium through spray header 25 also disposed above the conveyor. Liquid heating media passing over the containers and through the conveyor are collected in a trough 53 below the conveyor. An upright insulating partition 55 in trough 53 defines and serves as a barrier between a low temperature sump 57 upstream of the barrier and beneath the low temperature zone for collection of the low temperature medium and a high temperature sump 59 downstream of barrier 55 and beneath the higher temperature zone for collection of the higher temperature liquid. Partition 57 advantageously comprises a double wall 61 having a dead air space or insulation 63 between the panels of the wall. As described above, the low temperature medium is circulated through refrigerant condenser 11 by means of pump 21 and associated piping while the higher temperature medium is circulated through steam heated heat-exchanger 19 by means of pump 27.

An air blast provided by a blower 65 and distributed through an air discharge slot 67 removes residual moisture from containers exiting housing 47 after passage through zone 17. The warmed containers are picked up and removed from the machine by a discharge conveyor 69.

The following examples illustrate the invention:

EXAMPLE 1

Warming curves were established for 2 liter polyethylene terephthalate containers filled with a carbonated soft drink. In obtaining these curves a number of filled containers were placed in a box and sprayed with warming solution from spray jets disposed above the containers. Conditions in a conventional warming machine were duplicated with respect to the center-to-center distance between spray jets (approximately twelve inches), the height of the spray jets above the containers (twelve to thirteen inches), and the flow rate of warming solution per nozzle (approximately four gallons per minute). Measurements were taken of internal container temperature as a function of time for spraying with warming solution at a predetermined temperature which was maintained constant throughout a given test cycle. Temperature as a function of time was measured by sequentially removing containers from the box at predetermined time intervals, opening the container removed, stirring the contents to establish a uniform temperature therein, and measuring the liquid temperature. The temperature measurements were plotted against time to provide a warming curve for the containers tested. Different warming curves were obtained using different temperature warming solutions.

Figure 5:
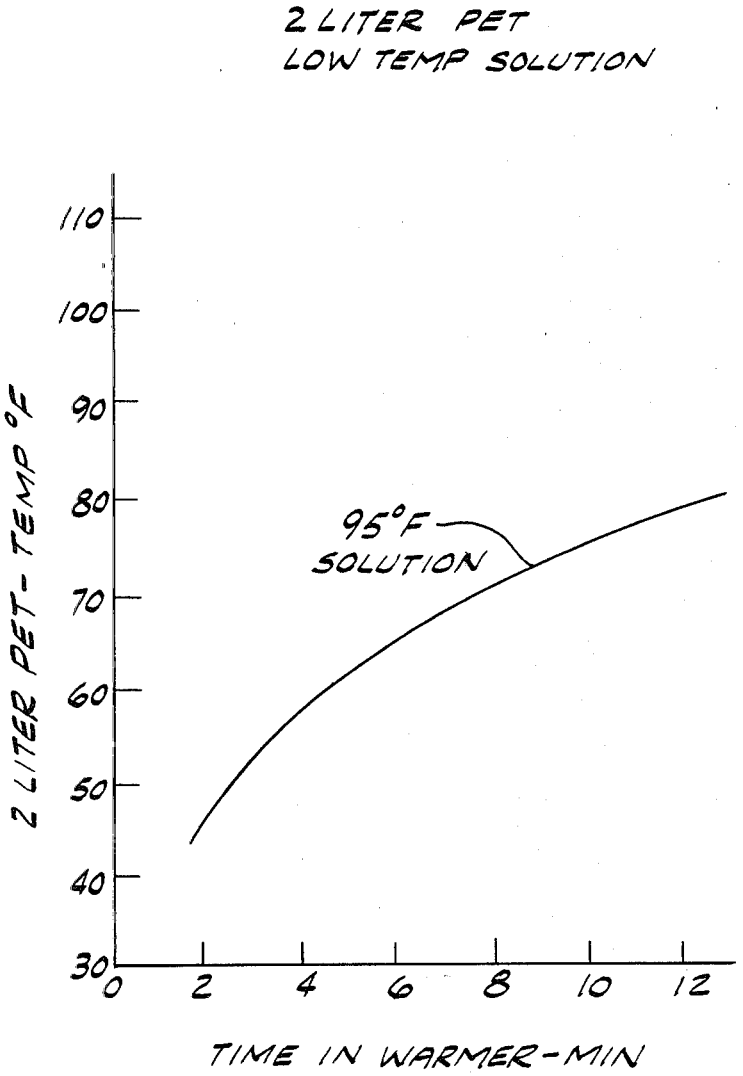
FIG. 5 is a warming curve obtained by plotting the carbonated liquid temperature inside a 2-liter polyethylene terephthalate bottle as a function of time when sprayed with 95° F. warming solution under conditions comparable to those obtained in a conventional warming machine.
Figure 6:
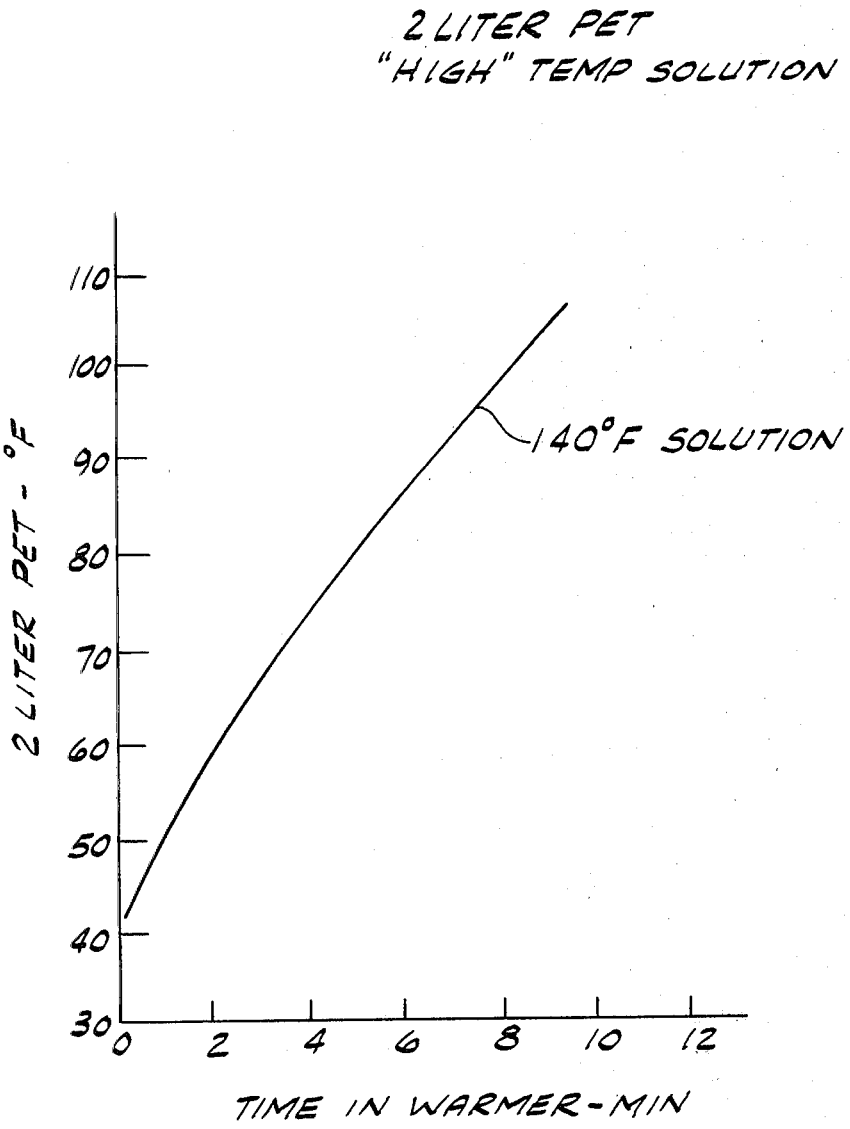
FIG. 6 is a curve comparable to FIG. 3 obtained using 140° F. warming solution.

Set forth in FIG. 5 is the warming curve for 2-liter polyethylene terephthalate containers filled with carbonated soft drink and heated with 95° F. warming solution, a temperature achievable through heat exchange between the fluid heating medium and ammonia condensing at 185 psia. FIG. 6 shows the comparable curve for heating filled 2 liter polyethylene terephthalate containers using a liquid heating medium at 140° F., a temperture which can be conveniently maintained by circulation of the medium through an external heat exchanger heated with steam. In the test work conducted to obtain the warming curve, there was some scatter of data but good statistical correlation was found between the data and exponential solution temperature versus time equations so that these equations were used to develop the smooth curves illustrated in the drawings.

Figure 7:
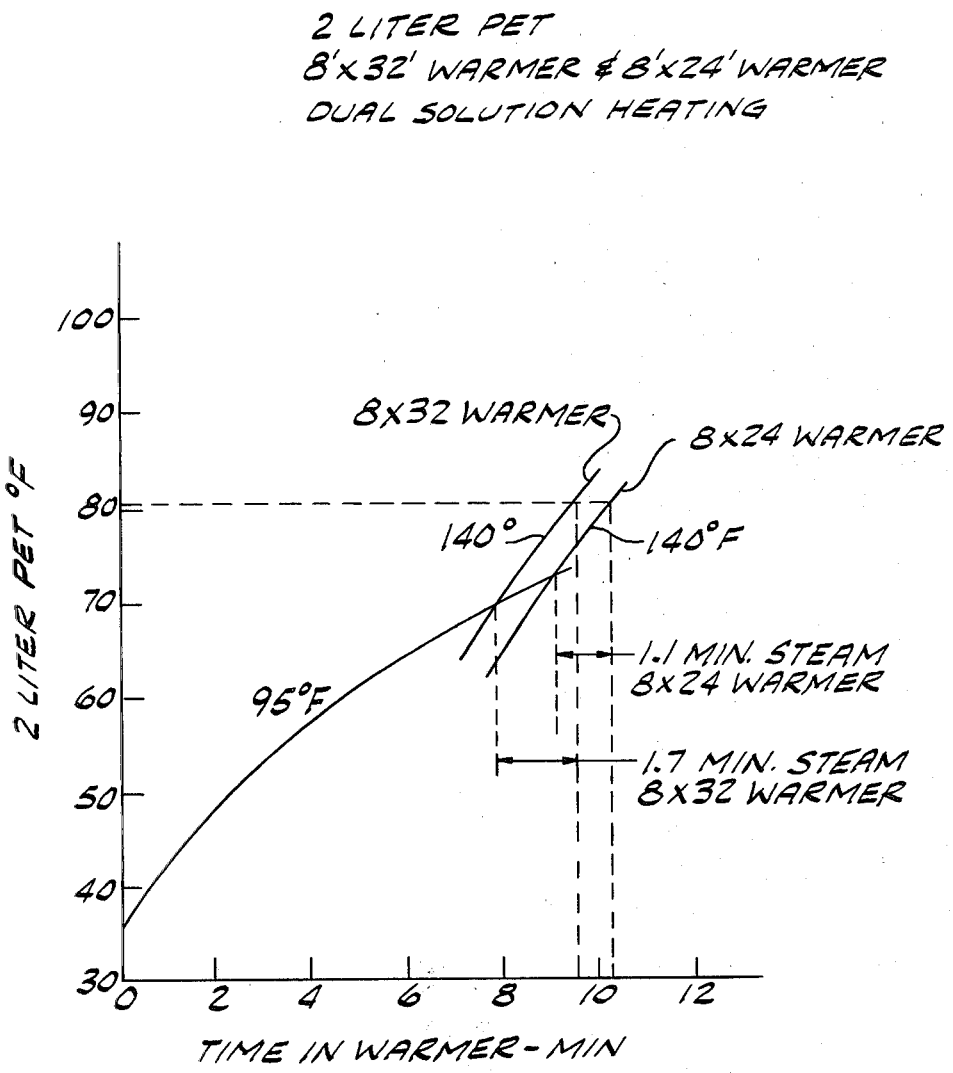
FIG. 7 sets forth composite warming curves for two-stage warming of 2-liter polyethylene terephthalate containers filled with carbonated liquid utilizing 95° F. warming solution in the first stage and 140° F. warming solution in the second stage, one composite relating to an 8 ft.×32 ft. warmer and the other composite relating to an 8 ft.×24 ft. warmer.

In a conventional 8 ft.×24 ft. warming machine, 2 liter polyethylene terephthalate containers filled with carbonated soft drink are heated to an exit temperature of 80° F. in 10.2 minutes residence time using 115°–120° F. warming solution. To establish the same productivity for warming these containers with a two-stage system of the type illustrated in FIGS. 1, 2, and 3, the 95° F. warming curve was plotted forward from the point (time=0; temperature=36° F.), the 140° F. warming curve was backplotted from the point (time=10.2 min.; temperature=80° F.), and the intersection of these two curves determined in the manner discussed above with respect to FIG. 4. Results of this exercise are illustrated in FIG. 7 which indicates that standard productivity can be maintained by spraying the containers with the low temperature medium (heated by condensing ammonia) for 9.1 minutes and heating with the high temperture medium for 1.1 minutes. Also shown in FIG. 7 are the curves for determining the relative 2 stage heating periods for filled 2 liter polyethylene terethphalate containers in an 8 ft.×32 ft. warming machine in which the containers are conventionally heated to 82° F. in a residence time of 9.5 minutes. From the plot it can be determined that equivalent productivity is maintained by heating with the low temperature ammonia condensation heated low temperature fluid medium for 7.8 minutes and with the high temperature steam heated medium for 1.7 minutes.

EXAMPLE 2

Figure 8:
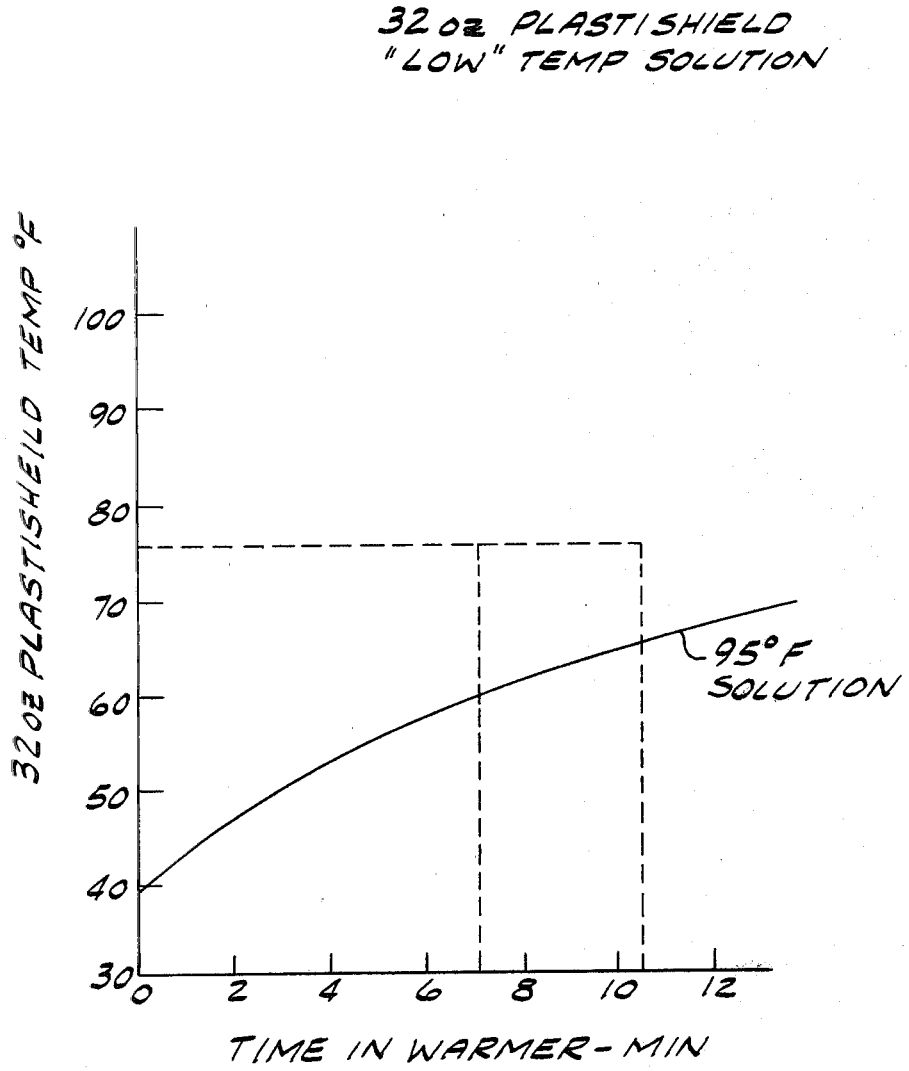
FIG. 8 is a plot, comparable to that of FIG. 5, for warming 32 oz. Plasti-shield bottles containing carbonated liquid.
Figure 9:
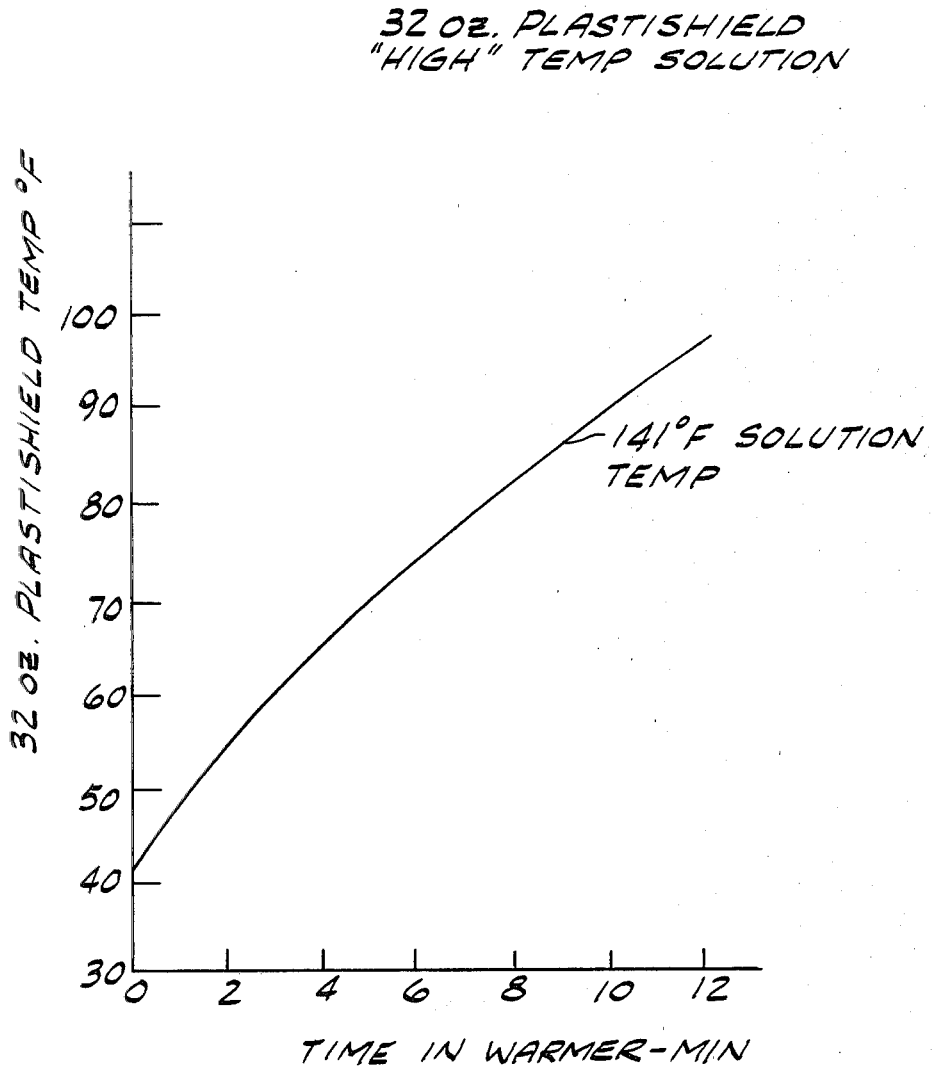
FIG. 9 is a curve, comparable to that of FIG. 6, for warming of 32 oz. Plasti-shield bottles containing carbonated liquid.
Figure 10:
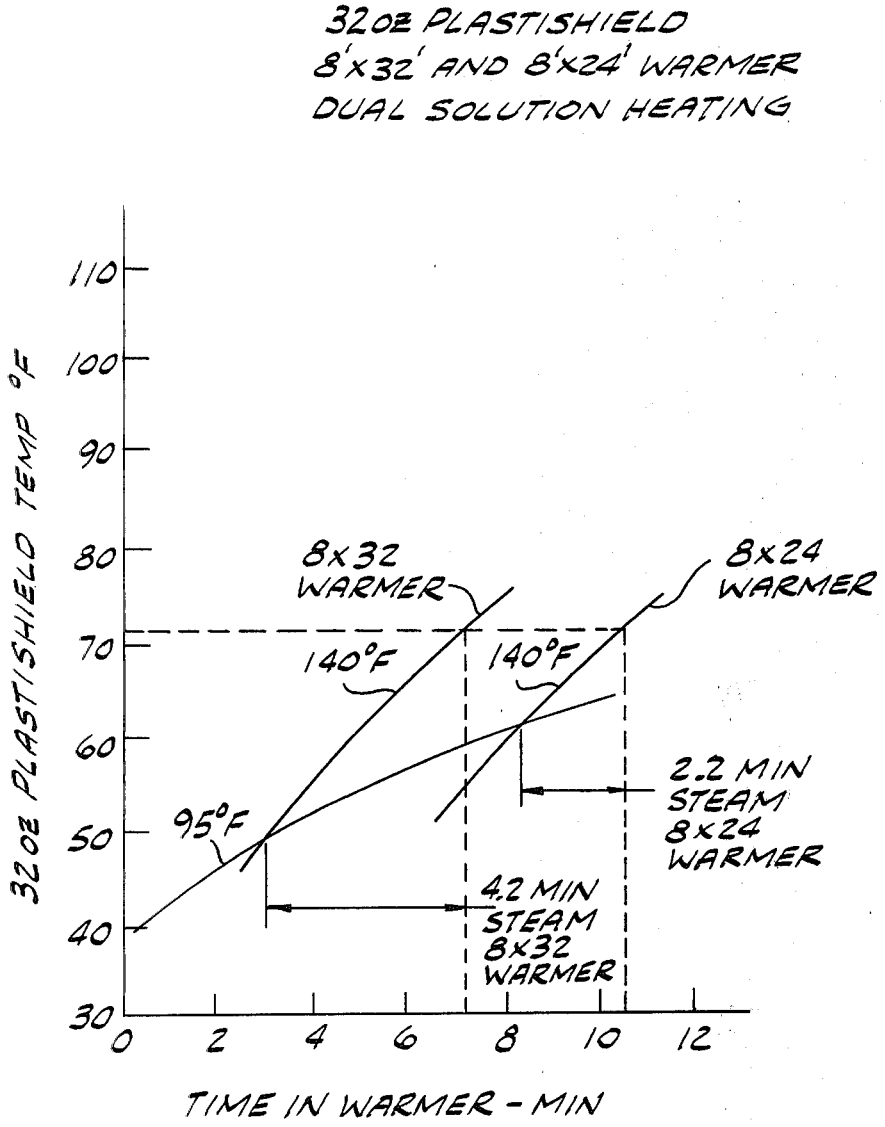
FIG. 10 sets forth composite warming curves for two-stage warming of 32 oz. Plasti-shield bottles containing carbonated liquid using 95° F. warming solution in the first stage and 140° F. warming solution in the second stage, one curve being for an 8 ft.×32 ft. warmer, and the other curve for a 8 ft. by 24 ft. warmer.

Utilizing the method described in example 1, warming curves were established for heating 32-oz. Plastishield bottles (glass bottles having a plastic foam covering over the main body of the bottle) containing carbonated soft drink using a low temperature warming solution at 95° F. and a high temperature warming solution at 141° F. These curves are set forth in FIGS. 8 and 9, respectively. According to conventional practice, the filled 32 oz. Plasti-shield bottles are heated to 70° F. in 10.4 minutes in an 8 ft.×24 ft. warming machine and are heated to 70° F. in 7.0 minutes residence time in an 8 ft.×32 ft. warming machine. Using the method illustrated in FIG. 4, it was determined that the 32 oz. Plasti-shield bottles could be heated to 70° F. by 8.2 minutes exposure to 95° F. solution and 2.2 minutes exposure to 140° F. warming solution in an 8 ft.×24 ft. machine; and that the same containers could be heated to 70° F. by 2.8 minutes to exposure to the 95° F. solution and 4.2 minutes exposure to the 141° F. solution in the 8 ft.×32 ft. machine. The plots by which these determinations were made are illustrated in FIG. 10.

EXAMPLE 3

Figure 11:
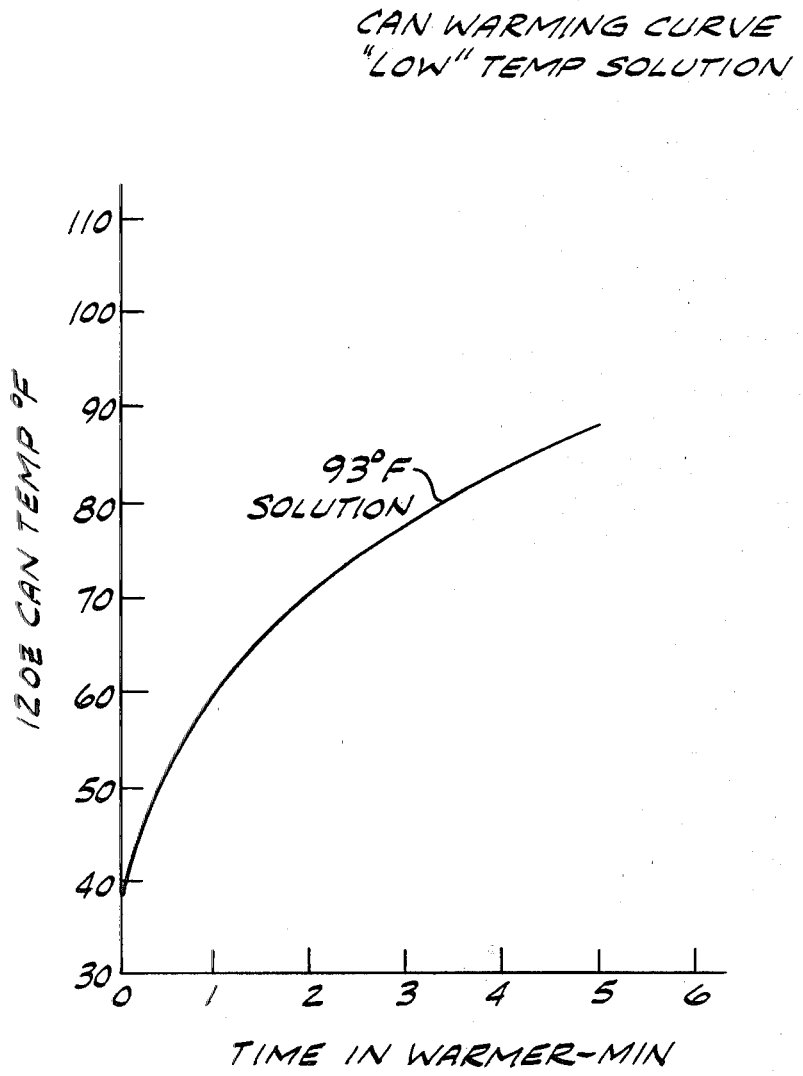
FIG. 11 sets forth warming curves, comparable to that of FIG. 5, for warming of 12-oz. metal cans filled with carbonated liquid.
Figure 12:
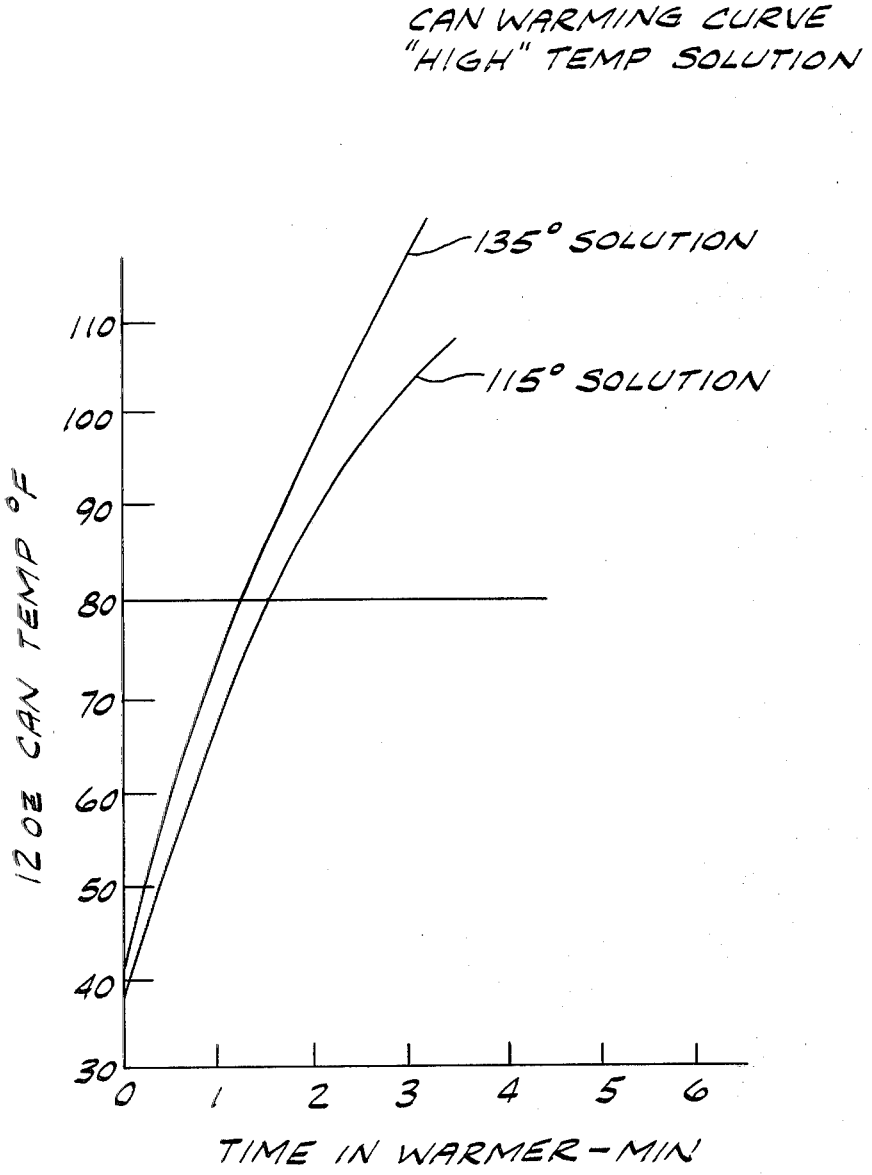
FIG. 12 shows curves, comparable to those of FIG. 6 for 12-oz. cans filled with carbonated beverages, one curve taken for 135° F. warming solution and the other taken for 115° F. warming solution.

Using the method described in example 1, warming curves were obtained for 12 oz. metal cans filled with carbonated soft drink using a low temperature warming solution of 93° F. and a high temperature warming solution of 135° F. These curves are illusted in FIGS. 11 and 12 respectively.

Figure 13:
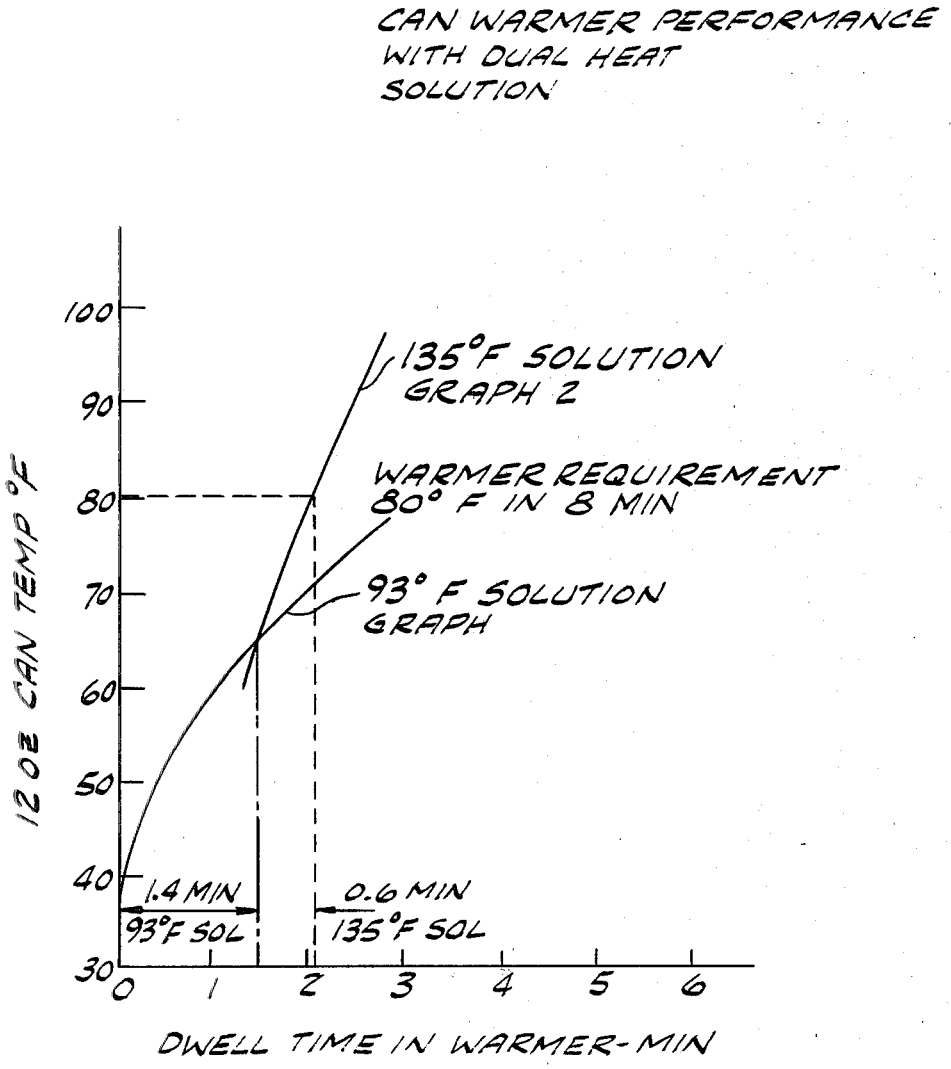
FIG. 13 sets forth a composite warming curve for two-stage warming of 12-oz. cans filled with carbonated liquid, the first stage using 93° F. warming solution and the second stage using 135° F. warming solution in a 6 ft.×16 ft. warmer.

In a 6 ft.×16 ft. warming machine in a commercial canning line, 12 oz. cans filled with carbonated soft drink are heated to an exit temperature of 80° F. in 2.0 minutes residence time. Using the method illustrated in FIG. 4, it was determined that 12 oz. cans could be heated to 80° F. by 1.4 minutes exposure to 93° F. warming solution, followed by 0.6 minutes exposure to 135° F. warming solution. The composite warming curve for 12 oz. cans is shown in FIG. 13.

As demonstrated by the above working examples, the method and apparatus of the invention enable the bottler to make significant reductions in the energy consumed in the liquid chilling and container warming phases of the bottling or canning operation. Necessary modifications to a conventional warming machine are relatively simple and the refrigerant condenser and auxiliary equipment are readily integrated into conventional bottling process schemes. Thus, not only does the method of the invention require only low capital expense, but also an existing bottling line is readily retrofitted to implement the method.

In view of the above, it will be seen that the several objects of the invention are achieved and other advantageous results attained.

As various changes could be made in the above methods and products without departing from the scope of the invention, it is intended that all matter contained in the above description or shown in the accompanying drawings shall be interpreted as illustrative and not in a limiting sense.

What is claimed is:

1. A method for heating closed containers having a product liquid therein utilizing the heat of condensation of a compressed refrigerant vapor comprising the steps of:

compressing a refrigerant vapor;

heating a first fluid medium by transfer of heat from said compressed refrigerant vapor, thereby condensing said vapor to provide a liquid refrigerant useful for cooling;

contacting said closed containers with said heated fluid medium in the first stage of a container heating system having a plurality of stages, thereby transferring heat from said first medium to said containers; and thereafter contacting said containers with a second fluid medium in a second stage of said system, said second medium entering said second stage at a temperature higher than the temperature at which said refrigerant vapor is condensed;

said containers being heated in said system to a temperature above the dew point of the ambient air, thereby preventing condensation of moisture on the outside surfaces of the side walls of said containers leaving said system.

2. A method as set forth in claim 1 wherein said first heating medium comprises a liquid that is circulated between said first stage and a surface condenser for transferring heat from said refrigerant vapor to said medium.

3. A method as set forth in claim 2 wherein said containers are continuously passed through said first stage and said medium is continuously circulated between said first stage and said surface condenser.

4. A method as set forth in claim 1 wherein said product liquid is cooled before it is introduced into said containers and said liquid refrigerant is used as a heat sink in cooling said product liquid prior to its introduction into said containers.

5. A method as set forth in claim 4 wherein said product liquid is carbonated.

6. A method as set forth in claim 1 wherein said second medium is also liquid and containers are contacted in said stages by spraying said media thereon.

7. A method as set forth in claim 6 wherein said second medium is circulated between said second stage and a heat exchanger for supplying heat to said second medium.

8. A method as set forth in claim 7 wherein said containers are heated in a warming machine wherein said first stage comprises a first zone in which the containers are sprayed with said first medium and said second stage comprises a second zone in which said containers, after leaving said first zone, are sprayed with said second medium, each of said condenser and heat exchanger being external to said machine.

9. A method as set forth in claim 5 wherein said liquid refrigerant is subcooled by transfer of heat therefrom to liquid carbon dioxide for vaporization of said carbon dioxide and the vaporized carbon dioxide is used for carbonation of said product liquid.

10. A method as set forth in claim 4 wherein said refrigerant comprises ammonia.

11. In a process for bottling carbonated liquid wherein said liquid is cooled by refrigeration prior to the filling of containers with the liquid and the filled containers are thereafter closed and then warmed so that the surface temperature of the sides of each of the containers is above the dew point of the ambient air, thereby preventing condensation of moisture thereon prior to packing in cardboard cartons, the improvement which comprises:

compressing a refrigerant vapor;

transferring heat from a compressed refrigerant vapor to a first liquid heating medium, thereby condensing said vapor to provide a liquid refrigerant;

contacting the closed filled containers with said heated liquid medium in the first stage of a container heating system having a plurality of stages, thereby transferring heat from said first medium to said containers; and thereafter contacting said containers with a second liquid heating medium in a second stage of said system, said second medium entering said second stage at a temperature higher than the temperature at which said refrigerant vapor is condensed;

said containers being heated in said system to a temperature higher than the dew point of the ambient air, thereby preventing condensation of moisture on the outside surfaces of the side walls of said containers leaving said system.

12. A method as set forth in claim 11 wherein said liquid refrigerant is used as a heat sink in cooling said carbonated liquid prior to filling said containers.

13. Apparatus for heating containers having a product liquid therein and utilizing a low temperature heat source for supplying a portion of the heat comprising:

a housing containing a plurality of heating zones;

a horizontal belt conveyor for transporting said containers through said heating zones;

means for contacting said containers on said conveyor with a relatively low temperature liquid heating medium in a low temperature heating zone within said housing;

means for contacting said containers on said conveyor with a higher temperature liquid heating medium in a higher temperature heating zone within said housing downstream of said low temperature zone with respect to transit of said containers on said conveyor;

a trough in said housing below said conveyor for collection of said media after contact of said containers therewith; and an insulating partition in said trough defining and serving as a barrier between a low temperature sump upstream of said barrier and beneath said low temperature zone for collection of said low temperature medium and a higher temperature sump downstream of said barrier and beneath said higher temperature zone for collection of said higher temperature liquid medium.

14. Apparatus as set forth in claim 13 wherein each of said contacting means comprises means for spraying said medium on said containers.

15. Apparatus as set forth in claim 14 wherein said conveyor has openings therein for flow of said media therethrough to said sumps.

16. Apparatus as set forth in claim 13 further comprising a surface condenser external to said housing for transfer of heat from a compressed refrigerant vapor to said low temperature medium and condensation of said vapor, and means for circulating said low temperature medium from said low temperature sump through said condenser to said contacting means in said low temperature zone.

17. Apparatus as set forth in claim 16 further comprising means for heating said higher temperature medium after collection in said higher temperature sump and means for recirculating said higher temperature medium from said higher temperature sump to the contacting means in said higher temperature zone.

18. Apparatus as set forth in claim 17 wherein said means for heating said higher temperature medium comprises a surface heat exchanger external to said housing wherein said higher temperature medium is heated by a high temperature fluid.

19. Apparatus as set forth in claim 17 wherein said means for heating said higher temperature medium comprises a heating coil inside said higher temperature sump.

20. Apparatus as set forth in claim 17 further comprising a carbon dioxide vaporizer comprising a surface heat exchanger, means for delivery of liquid carbon dioxide thereto, and means for delivery of condensed refrigerant thereto from said surface condenser, whereby heat may be transferred from said condensed refrigerant to said carbon dioxide to vaporize the carbon dioxide and subcool the refrigerant.

21. Apparatus for heating containers having a product liquid therein utilizing the heat of condensation of a compressed refrigerant vapor comprising:

condenser means for transferring heat to a first fluid heating medium from said compressed refrigerant vapor and condensing said vapor to provide a refrigerant liquid useful for cooling;

a heating system for said containers comprising a plurality of stages, the first stage of said system comprising means for contacting said containers with said first medium, the second stage of said system comprising means for contacting said containers with a second fluid heating medium, heat exchanger means for transferring heat to said second fluid heating medium;

means for circulating said first medium between said condenser means and said first stage; and means for circulating said second medium between said heat exchanger means and said second stage.

22. Apparatus as set forth in claim 21 wherein each of said contacting means comprises means for spraying said containers with said medium.

23. Apparatus as set forth in claim 21 wherein said condenser means comprises a surface heat exchanger.

24. Apparatus as set forth in claim 21 further comprising carbon dioxide vaporizer means comprising a surface heat exchanger for transferring heat from said refrigerant liquid to liquid carbon dioxide and means for transporting said refrigerant liquid from said condensing means to said carbon dioxide vaporizer means.

* * * * *